US010608377B2

(12) United States Patent
Koellmann

(10) Patent No.: US 10,608,377 B2
(45) Date of Patent: Mar. 31, 2020

(54) ELECTRICAL PLUG CONNECTION

(71) Applicant: WAGO Verwaltungsgesellschaft mbH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/262,328

(22) Filed: Jan. 30, 2019

(65) Prior Publication Data

US 2019/0237904 A1 Aug. 1, 2019

(30) Foreign Application Priority Data

Jan. 30, 2018 (DE) ..... 10 2018 102 011

(51) Int. Cl.

| | |
|---|---|
| ***H01R 13/633*** | (2006.01) |
| ***H01R 13/627*** | (2006.01) |
| ***H01R 13/635*** | (2006.01) |
| ***H01R 4/48*** | (2006.01) |
| *H01R 11/05* | (2006.01) |
| *H01R 13/11* | (2006.01) |

(52) U.S. Cl.

CPC ..... *H01R 13/633* (2013.01); *H01R 4/4836* (2013.01); *H01R 13/6272* (2013.01); *H01R 13/635* (2013.01); *H01R 4/4845* (2013.01); *H01R 11/05* (2013.01); *H01R 13/112* (2013.01)

(58) Field of Classification Search

CPC ..... H01R 13/633; H01R 13/6272; H01R 13/6335

USPC ..... 439/160, 352, 638, 157, 329

See application file for complete search history.

(56) References Cited

U.S. PATENT DOCUMENTS 3,713,076 A * 1/1973 Gabrielian ..... H01R 13/627 439/352
4,196,954 A * 4/1980 Collignon ..... H01R 13/6273 439/152
4,435,033 A 3/1984 Gansert et al.
(Continued)

FOREIGN PATENT DOCUMENTS

DE 2912740 A1 10/1979
DE 20 2010 003 117 U1 7/2010
(Continued)

*Primary Examiner* — Tulsida C Patel
*Assistant Examiner* — Peter G Leigh
(74) *Attorney, Agent, or Firm* — Muncy, Geissler, Olds & Lowe, P.C.

(57) ABSTRACT

An electrical plug connection having a plug connector and an associated counterpart mating plug connector. The plug connector can be plugged together in a plug direction with the mating plug connector for producing an electrical plug connection. The plug connector has a first locking mechanism and the mating plug connector has a second locking mechanism. The plug connector is fixable on the mating plug connector by a positive connection of the first locking mechanism with the second locking mechanism, and in an unlocking operation, this fixation can be disengaged by manual actuation of an unlocking element movably mounted on the plug connector or on the mating plug connector, in that the unlocking element mechanically acts on the first and/or the second locking mechanism when operated manually.

14 Claims, 1 Drawing Sheet

(56) References Cited

U.S. PATENT DOCUMENTS 4,531,795 A * 7/1985 Sinclair ..... H01R 13/633 439/152
4,658,107 A * 4/1987 Hildebrandt ..... H01H 35/10 200/80 R
4,708,413 A * 11/1987 Schroeder ..... H01R 13/6272 439/352
4,714,433 A * 12/1987 Rider, Jr. ..... H01R 13/6272 439/310
4,941,839 A * 7/1990 Nagasaka ..... H01R 13/639 439/352
4,946,395 A * 8/1990 Cope ..... H01R 13/6272 439/352
5,330,366 A * 7/1994 Tsuji ..... H01R 13/6271 439/352
6,669,398 B2 12/2003 Wada et al.
6,692,289 B2 * 2/2004 Nemoto ..... H01R 13/62977 439/160
6,902,420 B2 * 6/2005 Muro ..... H01R 13/6272 439/358
6,902,432 B2 * 6/2005 Morikawa ..... H01R 13/6275 439/607.41
8,480,424 B2 * 7/2013 Koellmann ..... H01R 4/4845 439/358
8,747,140 B2 * 6/2014 Gassauer ..... H01R 13/6335 439/352
2014/0004751 A1 1/2014 Fukushi
2017/0018874 A1 * 1/2017 Kida ..... H01R 13/4362
2017/0214154 A1 7/2017 Ludewig et al.
2017/0229812 A1 * 8/2017 Ehrman ..... H01R 13/6271

FOREIGN PATENT DOCUMENTS

DE 102010048698 A1 4/2012
DE 102011102715 A1 11/2012
DE 10 2012 104 857 A1 12/2013
EP 1133019 A2 9/2001
EP 2 445 056 A1 4/2012
FR 2 489 049 2/1982
GB 2082401 A 3/1982
WO WO 2017/102829 A1 6/2017

* cited by examiner

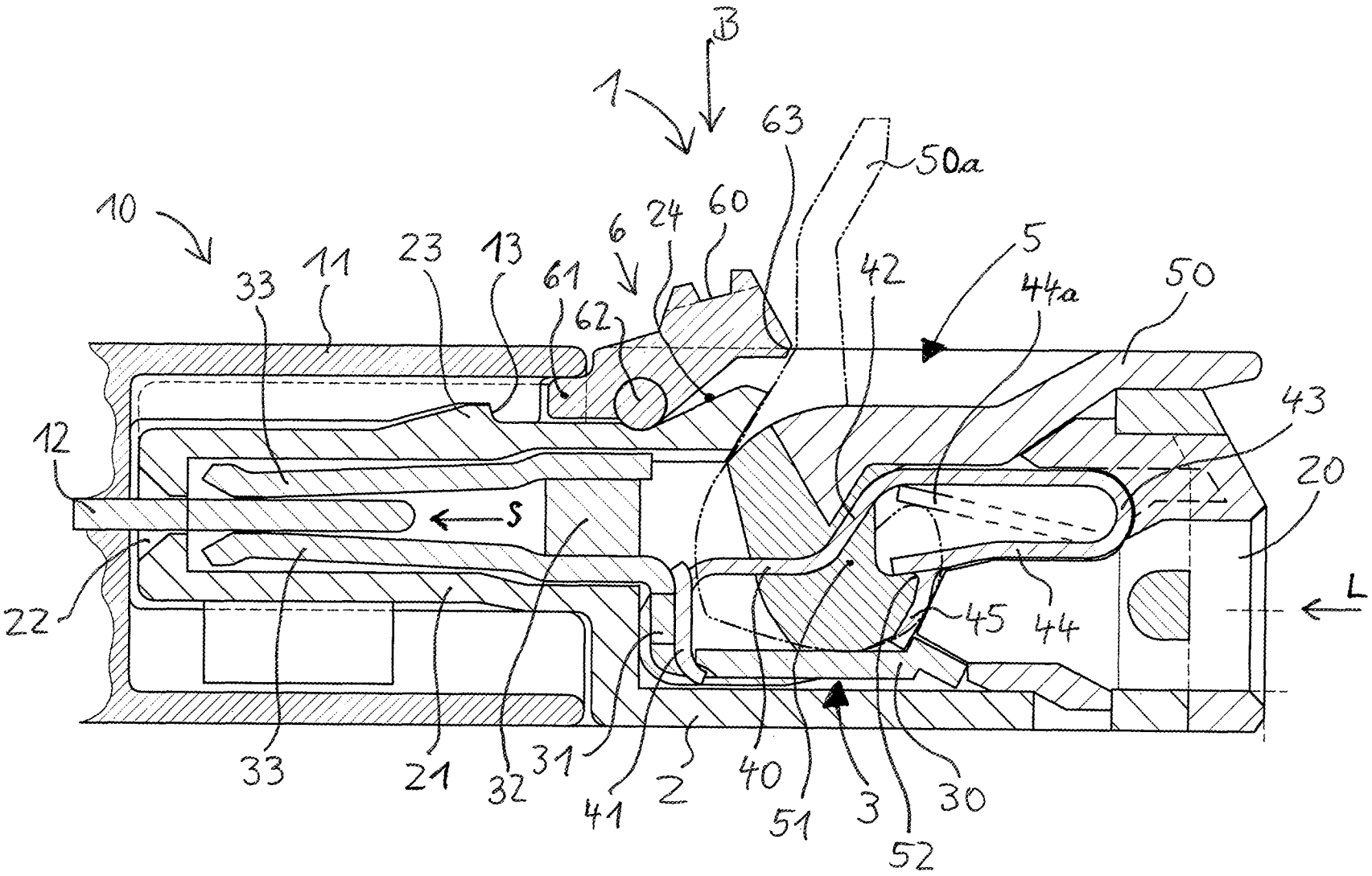
L
20
43
50
44a
5
44
45
30
52
50a
42
3
51
63
40
B
60
2
24
1
6
41
62
61
31
13
32
S
23
21
11
33
33
10
12
22

ELECTRICAL PLUG CONNECTION

This nonprovisional application claims priority under 35 U.S.C. § 119(a) to German Patent Application No. 10 2018 102 011.2, which was filed in Germany on Jan. 30, 2018, and which is herein incorporated by reference.

BACKGROUND OF THE INVENTION

Field of the Invention

The present invention relates to an electrical plug connection having a plug connector and an associated counterpart mating plug connector, wherein said plug connector can be fitted together with the mating plug connector for producing an electrical plug connection in a plug direction, wherein the plug connector has a first locking mechanism and the mating plug connector has a second locking mechanism, wherein the plug connector is fixable to the mating plug connector by a positive connection of the first locking mechanism with the second locking mechanism, and in an unlocking operation, this fixation is releasable by manual actuation of an unlocking element movably mounted on the plug connector or on the mating plug connector, in that the unlocking element mechanically acts on the first and/or the second locking mechanism when operated manually.

Description of the Background Art

A generic electrical plug connection is known from DE 10 2011 102 715 A1, which corresponds to U.S. Pat. No. 8,747,140, which is incorporated herein by reference.

SUMMARY OF THE INVENTION

It is an object of the present invention to provide an electrical plug connection with respect to a locking mechanism.

In an exemplary embodiment, an electrical plug connection is provided in that an unlocking element is pivotally mounted about a pivot axis on the plug connector or the mating plug connector, wherein on one side of the pivot axis, the unlocking element comprises a manual actuating region, which is configured for manual actuation of the unlocking element, and on the other side of the pivot axis, said element has a projecting actuating lug by means of which the first and/or the second locking mechanism is mechanically deflectable in the unlocking operation. This makes it possible to achieve a secure locking of the plug connector parts to each other while at the same time providing a simple way to disengage the fixation. In particular, a one-handed operation for disengaging the fixation is possible. The manual actuating region of the unlocking element can optionally be operated directly manually, for example with a finger, or indirectly via a tool, for example with a screwdriver.

Another advantage of the invention is that an electrical plug connection with little installation space can be produced and is therefore easily miniaturized. In addition, such an electrical plug connection also allows for the provision of a spring-loaded clamping connection, for example, in the plug connector or in the mating plug connector, or in both components, plug connector and mating plug connector.

The plug connector may have one or more plug contacts, for example male and/or female plug contacts, also assorted, for example in the form of contact pins, contact blades or fork contacts. The mating plug connector may also have plug contacts which are formed in a similar manner as the plug contacts of the plug connector, only in each case as a counterpart thereto.

The unlocking element can be actuated in an actuating direction, which is positioned at an angle to the plug direction of the plug connector. Accordingly, there is an angle between the actuating direction and the plug direction, for example, an angle of at least 40°. The angle may in particular also be a substantially right angle. As a result, the unlocking element can be manually operated particularly easily and conveniently.

The plug direction of the plug connector can define a direction in which the plug connector can be plugged together with the mating plug connector, which generally corresponds to a direction of movement in which the mating face of the plug connector is moved towards the mating face of the mating plug connector and the plug connector is then connected to the mating plug connector.

To provide the positive connection of the first locking mechanism with the second locking mechanism, these locking mechanisms may have respective locking elements, which are designed as positive counterparts to each other, for example in the form of latching elements, latching formations, latching tabs or latching recesses.

The fixation of the plug connector to the mating plug connector can be done without a particular manual actuation of one of the locking mechanisms, for example, in that the first locking mechanism and the second locking mechanism automatically form-fittingly interlock when plugging the plug connector and the mating plug connector together. In this case, for example, an elastic locking element can be automatically deflected during the connecting process, so that after reaching the final connection position of the plug connector and the mating plug connector, this elastic locking element can automatically snap back, thereby establishing the positive connection of the first locking mechanism with the second locking mechanism in the manner of an engagement.

At least one housing component of the plug connector or the mating plug connector can be expanded in the unlocking operation by the unlocking element. For example, in this way a locking tab, which is arranged on the housing component, can be widened in the sense of being levered open.

The unlocking element can therefore be designed as a pivotable lever or a rocker. For this purpose, the unlocking element may have one or more bearing elements, via which a defined bearing axis is fixed, which at the same time forms the pivot axis of the unlocking element. For example, laterally projecting bearing pins can be integrally formed on each unlocking element, which engage in corresponding pin recesses on the housing component to which the unlocking element is attached.

A component of plug connector and mating plug connector which comprises the unlocking element has at least one spring-loaded terminal connection for clamping an electrical conductor at a clamping point by means of spring force, wherein the spring-loaded terminal connection is movable from a closed position to an open position by means of an actuating element of this component. This allows for a simple and comfortable connection of an electrical conductor and also a secure permanent fixation of the electrical conductor at the clamping point.

The other component of plug connector and mating plug connector, which does not comprise the unlocking element, may also have a spring-loaded terminal connection for clamping an electrical conductor at a clamping point by means of a spring force.

The closed position of the spring-loaded terminal connection can correspond to a closed position of the actuating element. The open position of the spring-loaded terminal connection can correspond to an open position of the actuating element. The actuating element may be formed, for example, as an actuating lever which is pivotally mounted on the plug connector or the mating plug connector.

The unlocking element, in particular the manual actuating region of the unlocking element or a stop region of the unlocking element, can form a mechanical stop for the actuating element in the open position. The stop region can be arranged, for example, in the manual actuating region. In this way, excessive actuation of the actuating element is counteracted in the direction of the open position, without additional components being required for such a travel limit.

The unlocking element can be blocked by the actuating element against manual actuation when the actuating element is in the open position. This has the advantage that in the open position of the actuating element, the connected components of plug connector and mating plug connector cannot be detached from each other. For this purpose, the actuating element must first be moved in the direction of the closed position. The unlocking element can already be unblocked before the manual actuating element has fully reached the closed position.

The unlocking element can be arranged substantially centrally in the region of plug contacts of the plug connector and/or the mating plug connector. In this way, the unlocking element can be arranged at a central location of the plug connector or the mating plug connector so that it can be easily grasped when catching hold of the plug connector or the mating plug connector, and can be operated with one hand.

The spring-loaded terminal connection can comprise a busbar and a clamping spring, wherein the clamping spring is mounted self-supporting on the busbar. In this way, a spring-loaded terminal connection can be provided that is easy to manufacture and easy to install. Stresses on the surrounding components, such as on an insulating material housing, can be minimized.

The busbar and/or the clamping spring can be formed integrally with at least a part of a plug contact of the plug connector or the mating plug connector. The plug connector contact can be part of that component of the plug connector and mating plug connector which comprises the unlocking element. In this way, the plug connector contact can also be provided in a favorable manner in terms of production. In addition, a separate assembly is eliminated because the plug contact is already part of the busbar and/or the clamping spring. The entire plug connector contact may also be integrally formed with the busbar or the clamping spring.

The conductor insertion direction of the spring-loaded terminal connection can be substantially parallel or identical to the insertion direction. In this way, a compact, small-sized plug connector can be realized.

The clamping spring can have a clamping leg for clamping an electrical conductor, wherein a spring bow adjoins the clamping leg, and a contact leg, which is attached to the busbar, adjoins the spring bow. The clamping spring may, for example, be shaped as a loop.

The spring bow can extend away from the contact leg, counter the conductor insertion direction. Thus, if an electrical conductor is inserted in the spring-loaded terminal connection in the conductor insertion direction, then said conductor is guided in the direction of the spring bow and subsequently guided past the spring bow. The spring bow can then be located in a range between a handle region of the actuating element, via which the actuating element is to be operated manually, for example, a lever grip, and the inserted electrical conductor.

The contact leg can be bent multiple times with at least two areas bent in the opposite bending direction. This also supports the compact design of the electrical plug connection. In a compact design, it is possible to accommodate a lever operation in the housing of the plug connector or the mating plug connector.

The contact leg, in particular the multiply bent region of the contact leg, can extend through a free space surrounded by the actuating element. Accordingly, the actuating element can engage around the clamping spring with, e.g., side sections extending laterally from the clamping spring. The actuating element can be supported counter to the force of the clamping leg on the busbar and/or a part of the clamping spring, e.g., on an extended portion of the contact leg, for example, in that the side sections rest on a corresponding support point of the busbar and/or a part of the clamping spring.

The invention is explained in more detail below with the aid of an embodiment using a drawing. The drawing FIG. 1 shows an electrical plug connection with a plug connector 1 and a mating plug connector 10 (only partially shown) in a side sectional view. The reference numerals used have the following meaning: (sic: kann nicht wirklich weg . . . )

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus, are not limitive of the present invention, and wherein the sole FIGURE illustrates an electrical plug connection with a plug connector and a mating plug connector in a side sectional view.

DETAILED DESCRIPTION

The plug connector 1 has a housing 2, for example, an insulating housing. The housing 2 has a conductor insertion opening 20. An electrical conductor can be inserted through the conductor insertion opening 20 in a conductor insertion direction L and clamped at a clamping point described below.

The plug connector 1 also has a spring-loaded terminal connection with a busbar 3 and a clamping spring 4, which are arranged as an electrical contact insert in the housing 2. The clamping spring 4 has a contact leg 40, which is fastened with an end-side end portion 41 extending substantially vertically to the conductor insertion direction L on a holding portion 31 of the busbar 3 extending likewise substantially vertically to the conductor insertion direction L. In this way, the clamping spring 4 is fixed to the busbar 3. The contact leg 40 extends over a multiply bent portion 42 toward a spring bow 43, to which a clamping leg 44 of the clamping spring 4 is connected. The clamping leg 44 terminates in a clamping lug 45, which together with a conductor connection region 30 of the busbar 3 forms a clamping point for clamping an electrical conductor.

The plug connector 1 also comprises an actuating element 5 in the form of a pivotable actuating lever. The actuating element 5 has a handle portion 50 on which a user can manually operate the actuating element 5. The actuating element 5 is used to open the clamping point in order to facilitate the insertion of an electrical conductor or to allow for the removal of an already clamped electrical conductor. For this purpose, the actuating element 5 has a spring entrainment member 52 which can press against a region of the clamping leg 44 and in this way deflect the clamping leg 44, including the clamping lug 45. The FIGURE shows the clamping spring with the clamping point closed in solid lines. In this case, the actuating element is also in the closed position, which is likewise shown in solid lines. The FIGURE additionally shows the actuating element in the open position, which is shown in dotted-dashed lines. In this case, the clamping leg 44 is deflected upwardly by the spring entrainment member 52, which is indicated by the reference numeral 44*a* and the representation of the clamping leg in dashed lines. The handle portion 50 is represented in this case by the reference numeral 50*a*.

In a housing portion 21 projecting towards the mating plug connector 10, the plug connector 1 also has a plug connector contact 33, which may be realized, for example, by two fork legs and accordingly forms a fork contact. Here, the fork legs of the plug connector contact 33 may be integrally formed with the busbar 3, for example, in that the fork legs 33 are connected to each other via a vertical portion 32 of the busbar material, and these in turn are connected to the holding portion 31.

The mating plug connector 10 has its own housing 11, for example, made of insulating material. The mating plug connector 10 has a plug connector contact 12, which is designed as a counterpart to the plug connector contact 33, for example, as a blade contact or as a pin contact. This plug connector contact 12 can be inserted in the plug connector 1 through an insertion opening 22 in the housing portion 21 and is received between the fork legs of the plug connector contact 33.

The plug connector 1 can accordingly be plugged together with the mating plug connector 10 in a plug direction S.

In order to prevent undesired loosening of the plug connector 1 from the mating plug connector 10, a positive connection is provided by means of a first locking mechanism 23 of the plug connector, and a second locking mechanism 13 by means of the mating plug connector. As the FIGURE shows, the first locking mechanism 23 can engage or snap into place (in the sense of a locking element) behind the second locking mechanism 13 in a form-fitting manner. To disengage this fixation, i.e., for an unlocking operation, the area of the housing 11 of the mating plug connector 10 on which the second locking mechanism 13 is arranged can be mechanically deflected by means of an unlocking element 6, to such an extent that the positive connection between the first locking mechanism 23 and the second locking mechanism 13 is disengaged. For this purpose, the second locking mechanism 13 may, for example, be arranged on a flexible tab of the housing 11.

The unlocking element 6 is fastened to the plug connector 1, for example, on the outside of the housing 2. The unlocking element 6 is designed as a pivotable unlocking element rotatable about a rotational axis, which can be moved similar to a rocker. The unlocking element 6 has a manual actuating region 60, which serves for the manual actuation of the unlocking element 6. In order to actualize the axis of rotation of the unlocking element 6, the unlocking element 6 is rotatably mounted on the housing 2 via a bearing axis, for example, in the form of laterally projecting bearing pins 62. At the other end, i.e., on the other side of the pivot axis formed by the pivot pins 62, the unlocking element 6 terminates in a projecting actuating lug 61 which engages under a portion of the housing 11 of the mating plug connector 10. If the unlocking element 6 is actuated on the manual actuating region 60 in an actuating direction B, it performs a clockwise movement, which is limited by a stop surface 24 of the housing 2. Here, the actuating lug 61 lifts the part of the housing 11 having the second locking mechanism 13 so that the fixation is disengaged.

It can also be seen that the unlocking element 6 comprises a stop element 63, which serves as a stop and travel limit for the actuating element 5. The actuating element 5 can only be moved in the direction of the open position until it comes to rest on the stop element 63.

As can also be seen, the actuating element 5, in particular its handle portion 50, in the open position, ensures that the unlocking element 6 cannot be actuated for an unlocking operation because the stop element 63 comes to rest on the actuating element 5 and thus blocks further movement of the unlocking element 6.

The invention being thus described, it will be obvious that the same may be varied in many ways. Such variations are not to be regarded as a departure from the spirit and scope of the invention, and all such modifications as would be obvious to one skilled in the art are to be included within the scope of the following claims:

What is claimed is:

1. An electrical plug connection comprising:

a plug connector; and an associated counterpart mating plug connector, wherein the plug connector is adapted to be plugged together in a plug direction with the mating plug connector for producing an electrical plug connection, wherein the plug connector has a first locking mechanism and the mating plug connector has a second locking mechanism, wherein the plug connector is adapted to be fixed to the mating plug connector by a positive connection of the first locking mechanism with the second locking mechanism, wherein, in an unlocking operation, a fixation is disengaged by manual actuation of an unlocking element movably mounted on the plug connector or on the mating plug connector such that the unlocking element mechanically acts on the first and/or the second locking mechanism when operated manually, wherein the unlocking element is pivotally mounted about a pivot axis on the plug connector or the mating plug connector, wherein on a first side of the pivot axis, the unlocking element comprises a manual actuating region, which is configured for manual actuation of the unlocking element, and on a second side of the pivot axis, has a projecting actuating lug via which the first and/or second locking mechanism is mechanically deflectable in the unlocking operation, and wherein a component of the plug connector and mating plug connector having the unlocking element comprises at least one spring-loaded terminal connection for clamping an electrical conductor to a clamping point via a spring force, and wherein the spring-loaded terminal connection is movable from a closed position to an open position by an actuating element of the component.

2. The plug connection according to claim 1, wherein the unlocking element is actuated in an actuating direction, which is arranged at an angle to the plug direction of the plug connection.

3. The plug connection according to claim 2, wherein the actuating direction is arranged substantially at a right angle to the plug direction of the plug connection.

4. The plug connection according to claim 1, wherein at least one housing component of the plug connector or the mating plug connector is expanded by the unlocking element in the unlocking operation.

5. The plug connection according to claim 1, wherein the unlocking element or a manual actuating region of the unlocking element or a stop portion of the unlocking element forms a mechanical stop for the actuating element in the open position.

6. The plug connection according to claim 1, wherein the unlocking element is blocked by the actuating element against manual actuation when the actuating element is in the open position.

7. The plug connection according to claim 1, wherein the spring-loaded terminal connection has a busbar and a clamping spring, wherein the clamping spring is attached to the busbar to be self-supporting.

8. The plug connection according to claim 7, wherein the busbar and/or the clamping spring are integrally formed with at least a part of a plug connector contact of the plug connector or the mating plug connector.

9. The plug connection according to claim 7, wherein the clamping spring has a clamping leg for clamping an electrical conductor, wherein a spring bow adjoins the clamping leg and a contact leg adjoins the spring bow, the clamping leg being attached to the busbar.

10. The plug connection according to claim 9, wherein the spring bow extends away from the contact leg counter to the conductor plug direction.

11. The plug connection according to claim 9, wherein the contact leg is multiply bent with at least two portions bent in the opposite bending direction.

12. The plug connection according to claim 11, wherein the contact leg or the multiply bent portion of the contact leg, extends through a free space surrounded by the actuating element.

13. The plug connection according to claim 1, wherein the conductor insertion direction of the spring-loaded terminal connection is substantially parallel or identical to the plug direction.

14. An electrical plug connection comprising:

a plug connector; and an associated counterpart mating plug connector, wherein the plug connector is adapted to be plugged together in a plug direction with the mating plug connector for producing an electrical plug connection, wherein the plug connector has a first locking mechanism and the mating plug connector has a second locking mechanism, wherein the plug connector is adapted to be fixed to the mating plug connector by a positive connection of the first locking mechanism with the second locking mechanism, wherein, in an unlocking operation, a fixation is disengaged by manual actuation of an unlocking element movably mounted on the plug connector or on the mating plug connector such that the unlocking element mechanically acts on the first and/or the second locking mechanism when operated manually, wherein the unlocking element is pivotally mounted about a pivot axis on the plug connector or the mating plug connector, wherein on a first side of the pivot axis, the unlocking element comprises a manual actuating region, which is configured for manual actuation of the unlocking element, and on a second side of the pivot axis, has a projecting actuating lug via which the first and/or second locking mechanism is mechanically deflectable in the unlocking operation, and wherein the unlocking element is arranged substantially centrally in the region of plug contacts of the plug connector and/or the mating plug connector.

* * * * *